US008522455B2

(12) United States Patent
Rasmussen et al.

(10) Patent No.: US 8,522,455 B2
(45) Date of Patent: Sep. 3, 2013

(54) STRAP SYSTEM WITH INTEGRATED EYELET

(75) Inventors: Jeff Rasmussen, Portland, OR (US); David J. Dirsa, Beaverton, OR (US); Matthew T. Gregg, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 1220 days.

(21) Appl. No.: 11/735,124

(22) Filed: Apr. 13, 2007

(65) Prior Publication Data

US 2008/0250667 A1 Oct. 16, 2008

(51) Int. Cl.
*A43C 11/00* (2006.01)

(52) U.S. Cl.
USPC ..... 36/50.1

(58) Field of Classification Search
USPC ..... 36/50.1, 51; 434/260, 397
See application file for complete search history.

(56) References Cited

U.S. PATENT DOCUMENTS

| | | | | |
|---|---|---|---|---|
| 669,417 | A | 3/1901 | Klett | |
| 2,539,761 | A | 1/1951 | Whitman | |
| 4,079,527 | A * | 3/1978 | Antonious | 36/50.1 |
| 4,114,297 | A | 9/1978 | Famolare, Jr. | |
| 4,296,558 | A * | 10/1981 | Antonious | 36/50.1 |
| 4,308,672 | A * | 1/1982 | Antonious | 36/50.1 |
| 4,646,350 | A | 2/1987 | Batra | |
| 4,771,556 | A | 9/1988 | Kim | |
| D304,388 | S | 11/1989 | Brown | |
| 4,901,452 | A * | 2/1990 | Wang | 36/50.1 |
| D339,449 | S | 9/1993 | Hatfield | |
| 5,269,078 | A * | 12/1993 | Cochrane | 36/50.1 |
| 5,557,864 | A | 9/1996 | Marks | |
| 6,745,500 | B2 | 6/2004 | Suzuki et al. | |
| 6,772,541 | B1 * | 8/2004 | Ritter et al. | 36/88 |
| 6,954,996 | B2 * | 10/2005 | Borsoi | 36/50.5 |
| D517,300 | S | 3/2006 | Carr et al. | |
| 7,490,417 | B2 * | 2/2009 | Petrie | 36/50.1 |

FOREIGN PATENT DOCUMENTS

| | | |
|---|---|---|
| FR | 2586905 | 3/1987 |
| JP | 5084105 | 4/1993 |

* cited by examiner

*Primary Examiner* — Jila M Mohandesi
*Assistant Examiner* — Sharon M Prange
(74) *Attorney, Agent, or Firm* — Plumsea Law Group, LLC

(57) ABSTRACT

An article of footwear including two fastening systems is disclosed. The article of footwear includes a strap and a lacing system. The strap and the lacing system may all be configured to adjust or tighten the article of footwear to a wearer's foot along different regions. The strap and the lacing system are linked to improve the conformability of the article of footwear to a wearer's foot. Additionally, the link provides more control on the degree of tightening applied to a wearer's foot.

13 Claims, 6 Drawing Sheets

STRAP SYSTEM WITH INTEGRATED EYELET

BACKGROUND OF THE INVENTION

1. Field of the Invention

The present invention relates generally to footwear, and in particular the present invention relates to articles of footwear that include lacing systems and straps for tightening the upper to a wearer's foot.

2. Description of Related Art

Multiple systems for improved closure of an article of footwear to a wearer's foot have been proposed. Fanolare (U.S. Pat. No. 4,114,297) discloses a lacing system for an athletic shoe or sneaker applied in conjunction with a cinch-type closure disposed in throat region of footwear. The Fanolare cinch-type closure mechanism is comprised of a strap with a hook and loop closure region and a mating hook and loop closure region on upper. Brown (U.S. Pat. No. Des. 304,338) discloses a lacing system for an athletic shoe or sneaker applied in conjunction with a strap disposed through an opening on shoe upper. The strap has two mating hook and loop regions to secure tension applied by strap. Both closure systems proposed by Fanolare and Brown provide a strap disposed across the throat region of upper over the proximal region of the forefoot. A drawback to these proposed multiple fastening systems is that the combined fastening systems are not mechanically linked, which may not provide sufficient closure force to the articles of footwear. Furthermore, these systems provide strap closure systems disposed such that they will not apply closure to the distal region of the forefoot or the knuckles of the toes.

Footwear including a lacing system and multiple straps for tightening an upper to a wearer's foot have also been disclosed. In these systems, strap closure mechanisms may be disposed on the distal region of the forefoot. Marks (U.S. Pat. No. 5,557,864) discloses a footwear fastening system and method of converting a lace fastening system to a hook and loop fastening system. The fastening system incorporates tubular posts disposed between eyelets and laced to the upper by a lacing system. Subsequently, a plurality of hook and loop strips are disposed around tubular posts to provide a closure mechanism to upper. This system does not provide multiple closure systems that are mechanically linked, and often it may be required to have a combination of mechanically linked fastening mechanisms to provide the desired closure forces to an article of footwear.

Suzuki (U.S. Pat. No. 6,745,500) discloses a shoe fastening system containing a medial strap and a lateral strap. The lateral strap contains an elongated aperture wider than the medial strap and is secured to the medial aspect of upper with a hook and loop mechanism. The medial strap is inserted into aperture during fastening and is secured to the lateral aspect of the upper with a hook and loop mechanism. This system includes multiple straps for applying closure to the shoe upper. However, sometimes it may be desirable to provide a more evenly distributed closure force, which can be achieved through the use of a lacing system rather than multiple strap fastening systems.

There is a need in the art for an article of footwear that makes use of multiple mechanically linked systems of tightening the footwear upper to a wearer's foot, including a mechanism disposed on the distal region of the forefoot which effectively provides superior closure of upper to all regions of the forefoot.

SUMMARY OF THE INVENTION

The invention discloses an article of footwear with two fastening mechanisms. In one aspect, the article of footwear comprises an upper which can be adjustably tightened around a wearer's foot, a sole attached to the upper, a lacing system, and a strap. The strap includes a first portion and a second portion. The first portion of the strap is fixed to a first side of the upper and extendable across the article of footwear to a second side of the upper. The second portion of the strap is disposed through an opening in the second side of upper.

In another aspect, the strap is disposed in a forefoot region of the upper along the first side of the upper and extends circumferentially towards the sole.

In another aspect, the second portion of the strap is fixed to the second side of the upper.

In another aspect, the strap applies tension in a first region of the upper when the strap is extended to the second side of the upper.

In anther aspect, the second portion of the strap is fixed to the first side of the upper.

In another aspect, the strap applies tension in a forefoot region of the upper when the strap is extended to the first side of the upper.

In another aspect, the lacing system applies tension to the upper by reducing the size of a throat opening.

In another aspect, the invention provides an article of footwear, comprising an upper which can be adjustably tightened around a wearer's foot, a sole attached to the upper, a lacing system, and a strap. The strap includes a first portion, a second portion, and an intermediate portion. The first portion of the strap is fixed to a first side of the upper and extendable across the article of footwear to a second side of the upper. The second portion of the strap is disposed through an opening in the second side of upper. The intermediate portion is disposed between the first portion and the second portion.

In another aspect, the laces are disposed proximate to a throat region of the upper.

In another aspect, the strap is disposed in a forefoot region of a wearer's foot.

In another aspect, the intermediate portion of the strap contains an elongated slot.

In another aspect, the intermediate portion of strap is disposed through at least one slot in a throat region of the upper.

In another aspect, the invention provides an article of footwear comprising an upper which can be adjustably tightened around a wearer's foot, a sole attached to the upper, a lacing system, and a strap. The strap includes a first portion, a second portion, and an intermediate portion. The first portion of the strap is fixed to a first side of the upper and extendable across the article of footwear to a second side of the upper. The intermediate portion of the strap is disposed through an opening in the second side of upper with a link between lacing system and strap.

In another aspect, the intermediate portion of the strap contains an elongated slot.

In another aspect, the intermediate portion of strap is disposed through at least one slot in throat region of upper.

In another aspect, wherein the strap includes an opening to receive a lace.

In another aspect, the upper includes a lace eyelet for receiving lace.

In another aspect, the lace eyelet is disposed under at least one opening in the upper.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
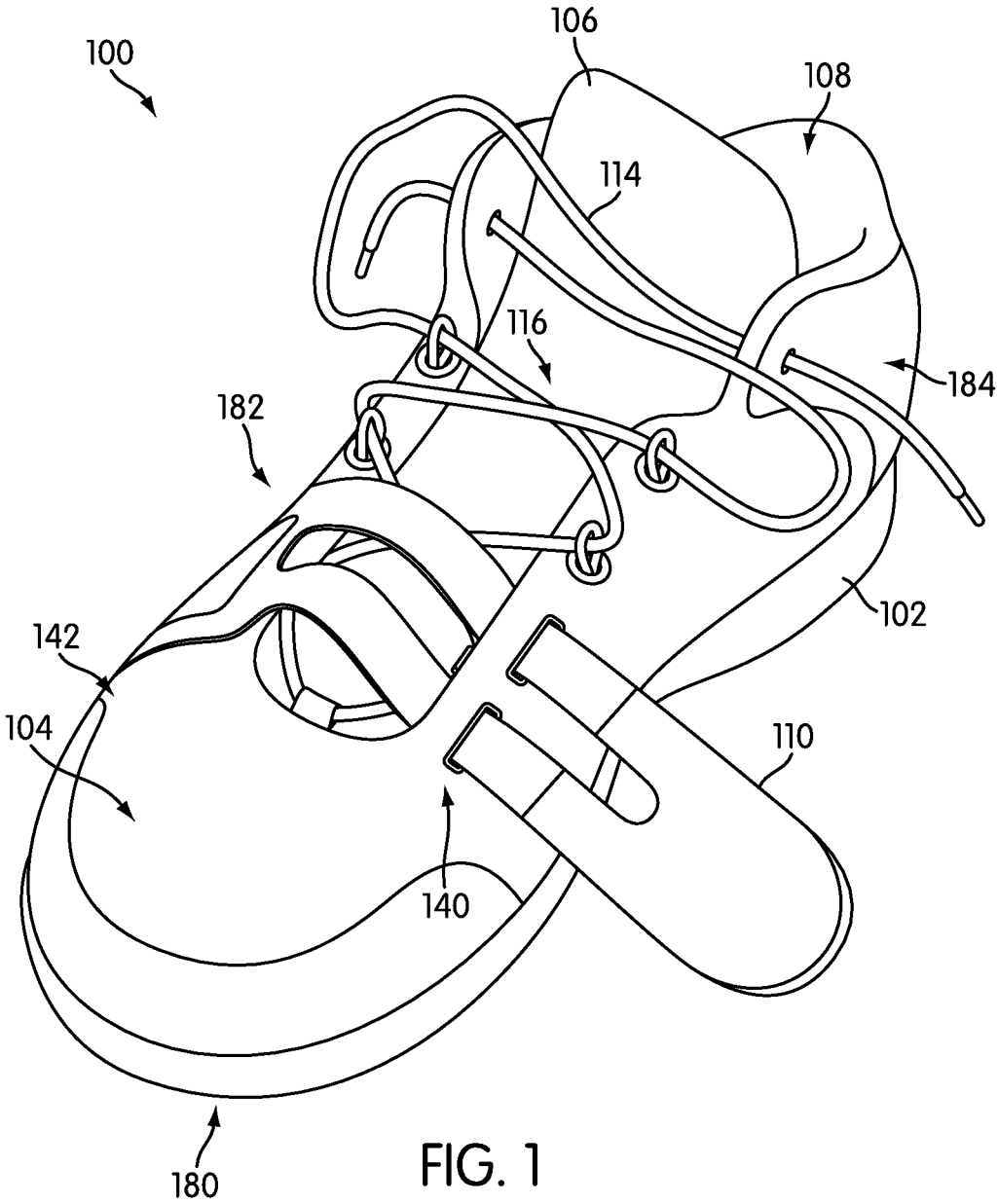
FIG. 1 is an isometric view of a preferred embodiment of an article of footwear.

FIG. 1 is an isometric view of a preferred embodiment of article of footwear 100. Article of footwear 100 may be any type of footwear. In some embodiments, article of footwear 100 may be a type of athletic footwear. Article of footwear 100 preferably includes sole 102 and upper 104. Sole 102 and upper 104 may be composed of any material. In particular, upper 104 may be composed of a synthetic material or a natural material such as leather. In some embodiments, upper 104 may be composed of multiple materials. Furthermore, upper 104 preferably includes forefoot region 180, throat region 182, and heel region 184.

In a preferred embodiment, upper 104 includes opening 108 and throat opening 116. Opening 108 is preferably configured to receive a wearer's foot. In a preferred embodiment, throat opening 116 coincides with throat region 182 of upper 104, and may allow additional space into which a wearer's foot may be placed in order to fully insert the foot into article of footwear 100. In preferred embodiment, upper 104 may also include tongue 106. Tongue 106 is a portion of upper 104 that may move independently from the remaining portions of upper 104. Tongue 106 generally corresponds with throat opening 116. Tongue 106 is preferably disposed between throat opening 116 and a wearer's foot, following the insertion of the wearer's foot.

Typically, an article of footwear includes some mechanism for tightening or closing the upper around a wearer's foot. Often, a lacing system is provided to constrict the throat of the upper. As the throat of the upper constricts, the upper is tightened around the wearer's foot, especially in the instep region. Article of footwear 100 preferably includes lacing system 114. Lacing system 114 preferably allows a wearer to tighten upper 104 to the wearer's foot. In a preferred embodiment, lacing system 114 is disposed adjacent to tongue 106 and proximate to throat region 182. As lacing system 114 is tightened, upper 104 is closed along throat region 182. Throat region 182 closes because a second side 140 and a first side 142 of upper 104 are pulled closer together, along an outer periphery of throat opening 116, as lacing system 114 is tightened. By closing throat opening 116 and opening 108, the wearer's foot can be prevented from slipping out of either throat opening 116 or opening 108.

Lacing system 114 may include any system intended to constrict the throat region of an article of footwear via tension applied along a narrow opening that separates a first side of an upper from a second side of an upper. Some examples of such lacing systems include zippers and shoe laces. These examples are not intended to be an exhaustive list of possible lacing systems. In the preferred embodiment, lacing system 114 includes a set of shoelaces.

In addition to lacing system 114, article of footwear 100 may include a second mechanism for adjustable tightening of upper 104 around a wearer's foot. Preferably, article of footwear 100 includes strap 110 for adjustably tightening upper 104 to a wearer's foot. In some embodiments, strap 110 is disposed on upper 104. Preferably, strap 110 is disposed in throat region 182 of upper. In a preferred embodiment, strap 110 is disposed in throat region 182 near forefoot region 180 of upper 104.

Generally, strap 110 may be used to selectively tighten a portion of upper 104 around a wearer's foot. Usually, though a lacing system helps to constrict the upper around a wearer's foot, tightening the lacing system does not secure the forefoot region of a wearer's foot in place. Using strap 110 allows a wearer to secure their forefoot in place while simultaneously tightening the upper around a wearer's foot along the instep region through the use of lacing system 114.

Figure 2:
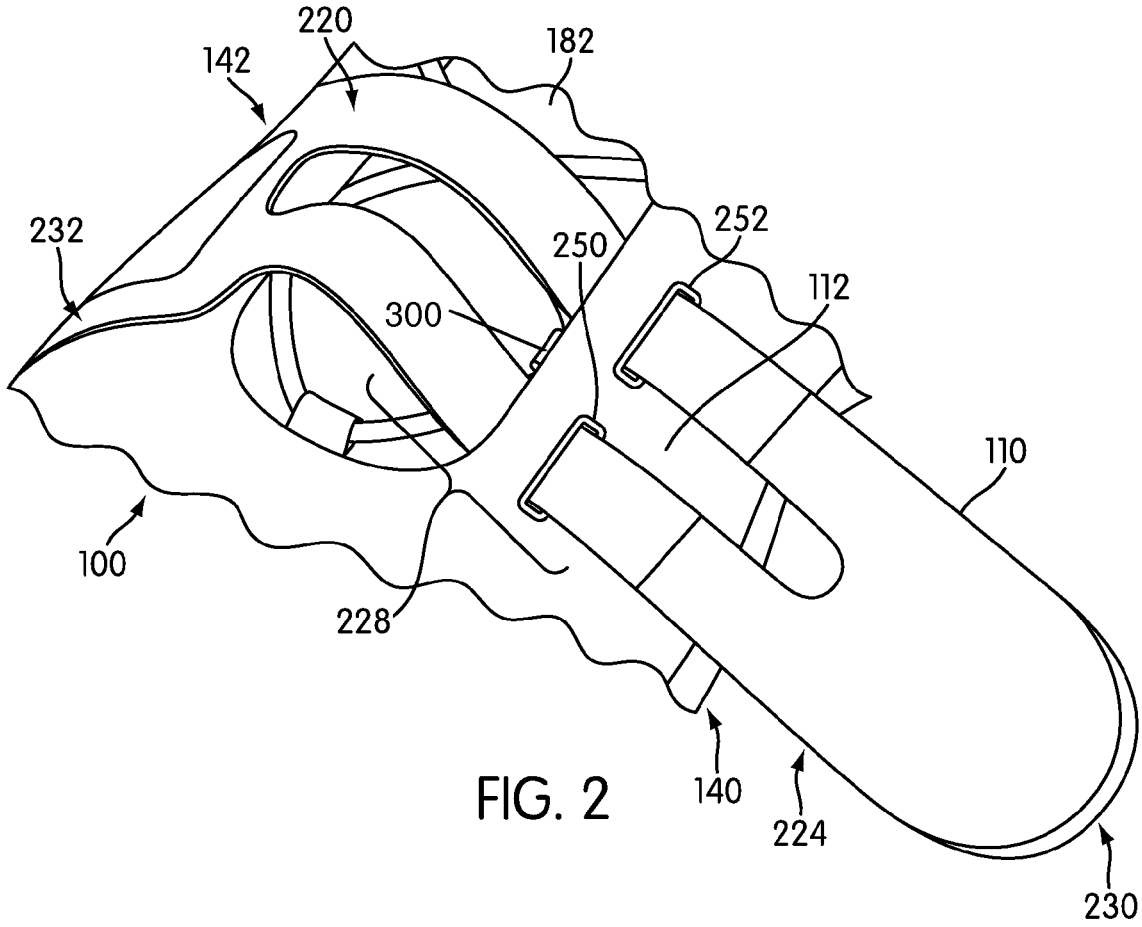
FIG. 2 is a scaled view of a region of a preferred embodiment of an article of footwear.

A preferred configuration of strap 110 may be seen in FIG. 2, which is an enlarged view of a preferred embodiment of article of footwear 100. Strap 110 preferably includes a first portion 220 and second portion 224. First portion 220 of strap 110 includes a first end joined to upper 104. While shown as being attached to an outer surface of upper 104, strap 110 may alternatively be attached to an inner surface or inner layer of upper 104. Second portion 224 of strap 110 includes a second end, which is generally free. Preferably, first end 232 of strap 100 is disposed on first side 142 of upper 104.

In preferred embodiment, strap 110 also includes intermediate portion 228 that is disposed between first portion 220 and second portion 224 of strap 110. In some embodiments, intermediate portion 228 of strap 110 may be continuous or monolithic. More preferably, intermediate portion 228 of strap 110 may be configured so that the strap allows for articulation of a wearer's toes about toe knuckle joints. In a preferred embodiment, intermediate portion 228 of strap 110 may be configured with a central, elongated slot 112. Using this configuration, elongated slot 112 may provide ease of articulation of a wearer's toe knuckle joints when strap 110 is secured in place.

Some embodiments include provisions for selectively closing or tightening certain portions of throat region 182. In some embodiments, throat region 182 is configured with openings to receive strap 110. Preferably, intermediate portion 228 of strap 110 is disposed within throat openings provided in throat region 182 to accommodate strap 110. Slots 250 and 252 are preferably disposed in throat region 182 on the second side 140 of upper 104. In a preferred embodiment, slots 250 and 252 are disposed along throat region 182 of upper 104 near forefoot region 180. Using this configuration, lacing system 114 can be used to open and close throat region 182, while strap 110 can help to provide an additional adjustment to a wearer's forefoot or toe knuckle region.

In some embodiments, the two fastening systems may be associated. Generally, having two fastening systems, which may be similar or different, allows the wearer to more precisely tailor and control the tension placed on the foot at a particular point. For example, the wearer may wish to have an article of footwear very tightly fitted across forefoot region 180 so that the article of footwear does not slip against the foot when the wearer pivots on the balls of his or her feet. At the same time, the wearer may want the fit to be looser around the ankle so that the article of footwear does not inhibit the ankle's full range of motion. Similarly, if a wearer has a wide forefoot and a narrow ankle or heel, or vice versa, the fit may be tailored to accommodate such a foot if two fastening systems are used. Associating the fastening systems may conform an article of footwear to a wearer's foot. Additionally, associating the two fastening systems allows the wearer to more precisely tighten certain regions of article of footwear 100 while still balancing the forces placed on the wearer's foot. If the forces are imbalanced, the wearer's foot may not be properly supported by the article of footwear, increasing the chances of injury. Further, if the forces are imbalanced, the article of footwear itself may be subject to early failure, such as a broken sole or broken laces. By associating the two fastening systems, an excessive mismatch in tension as between the two systems is inhibited.

Figure 3:
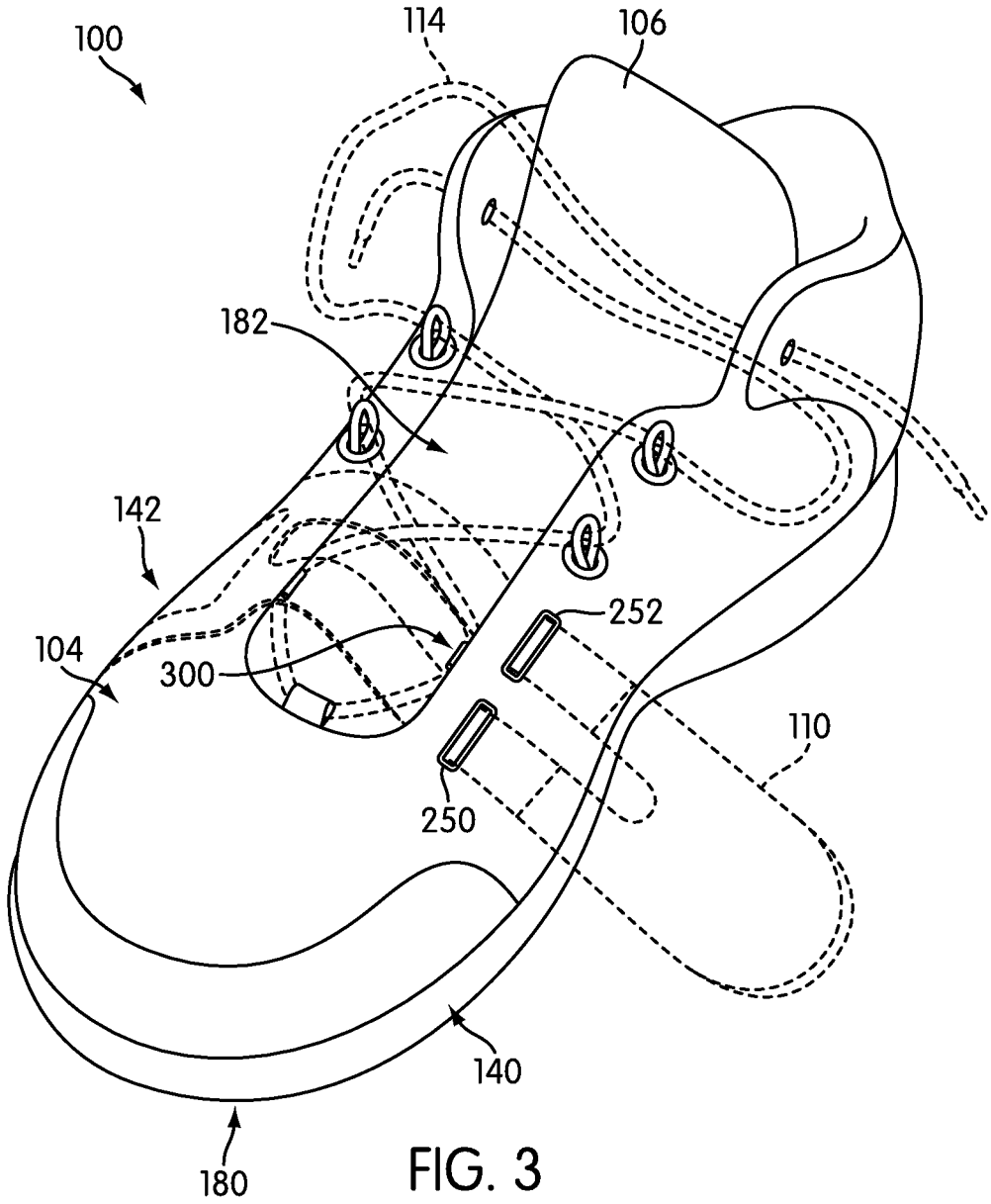
FIG. 3 is an isometric view of a preferred embodiment of an article of footwear with lace eyelet.
Figure 4:
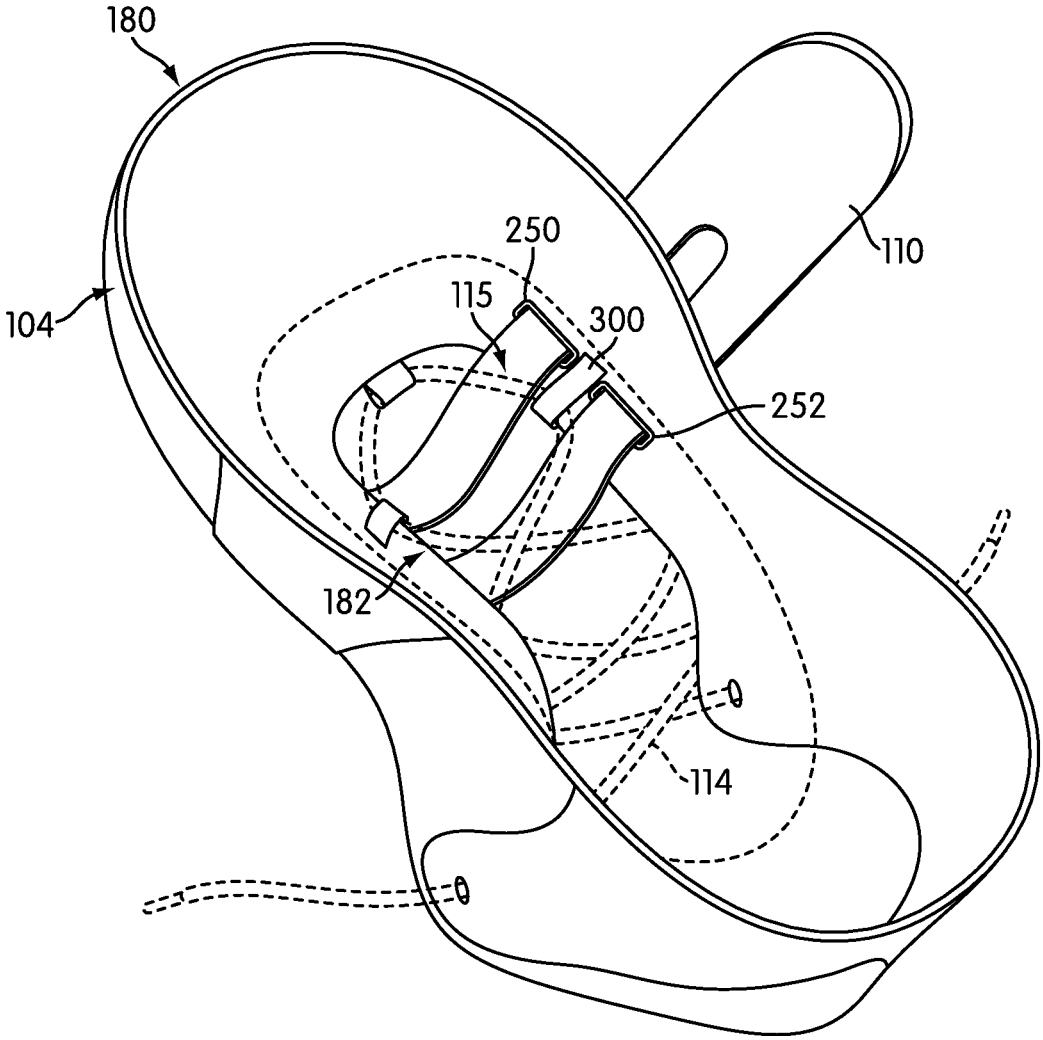
FIG. 4 is a view of an upper of a preferred embodiment of an article of footwear with lace eyelet.

Referring to FIGS. 3 and 4, a preferred embodiment of article of footwear 100 includes two fastening systems, lacing system 114 and strap 110, both of which are shown in phantom for clarity. Lacing system 114 is preferably disposed adjacent to tongue 106 and proximate to throat region 182, as depicted in FIG. 3. Strap 110 is preferably disposed on first region 142 of upper 104. Preferably, strap 110 is disposed on throat region 182 of upper 104 near forefoot region 180.

In a preferred embodiment, upper 104 is configured with slots 250 and 252 to receive strap 110. Additionally slots 250 and 252 are preferably disposed on second region 140 of upper near forefoot region 180. In some embodiments, the two fastening systems 114 and strap system 110 may be associated near strap system 110. In a preferred embodiment, the two fastening systems 110 and 114 may be associated near the region where strap system 110 engages upper 104. In an exemplary embodiment, the two strap systems 110 and 114 may be associated near slots 250 and 252, which are designed to accommodate strap system 110.

In a preferred embodiment, lace eyelet 300 disposed within upper 104 is used to associate the two fastening systems. As shown in FIG. 4, which a schematic view of upper 104 where tongue 106 of upper 104 is removed for clarity), lace eyelet 300 may preferably receive lace 115 from lacing system 114. Preferably, lace eyelet 300 may be disposed in a location that associates fastening systems 110 and 114. More preferably, lace eyelet 300 may be disposed near forefoot region 180 of upper 104. In a preferred embodiment, lace eyelet 300 may be disposed within upper 104 between slots 250 and 252.

Upon constriction of throat region 182 with lacing system 114, tension will be applied by eyelet circumferentially towards the sole. In the same manner, upon applying tension on strap 110, circumferential tension will be applied to openings 250, 252 towards the sole of the sole. The combination of circumferential tension applied by eyelet 300 and strap 110 result in enhanced stabilization of a wearer's foot in the forefoot region. Using this configuration, article of footwear 100 may be conformed to a wearer's foot through the use of link between fastening systems 110 and 114.

Figure 5:
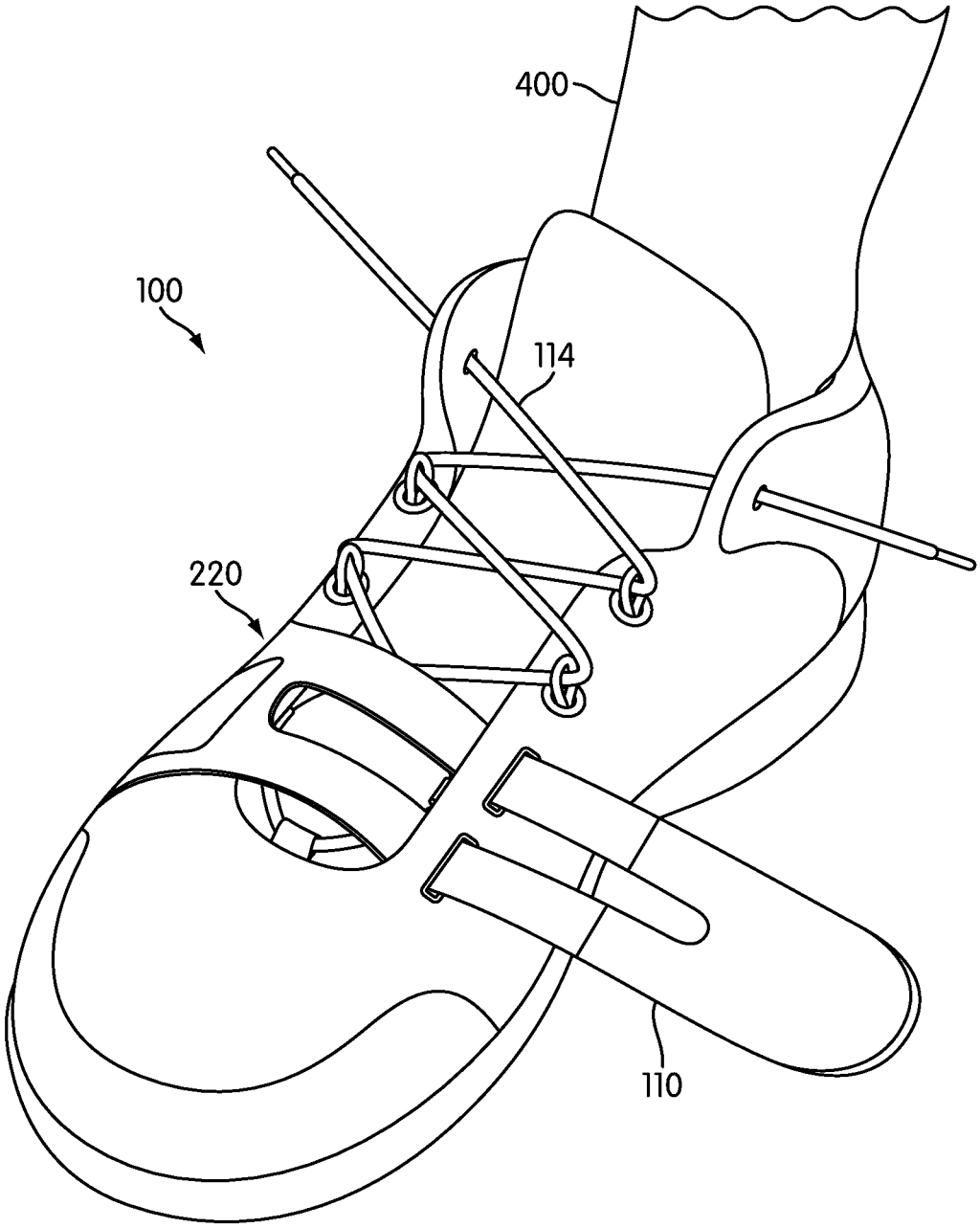
FIG. 5 is an isometric view of a preferred embodiment of an article of footwear with lace system tightened.

Tightening lacing system 114 can be the first step in adjusting the upper 104 to properly fit a wearer's foot. FIG. 5 shows one way to tighten lacing system 114 in a preferred embodiment of article of footwear 100 after a wearer's foot 400 has been disposed into article of footwear 100. Lacing system 114 may be tightened first to tighten upper 104 to wearer's foot 400 along the instep region of the foot. In some embodiments, strap 110 may be disposed in a location that allows for lacing system 114 to be adjusted independently of strap 110 prior to strap 110 being secured. In a preferred embodiment, first portion 220 of strap 110 is disposed above lacing system 114. Using this configuration, lacing system 114 may be able to tighten upper 104 to wearer's foot 400 independently of and prior to securing strap 110.

Figure 6:
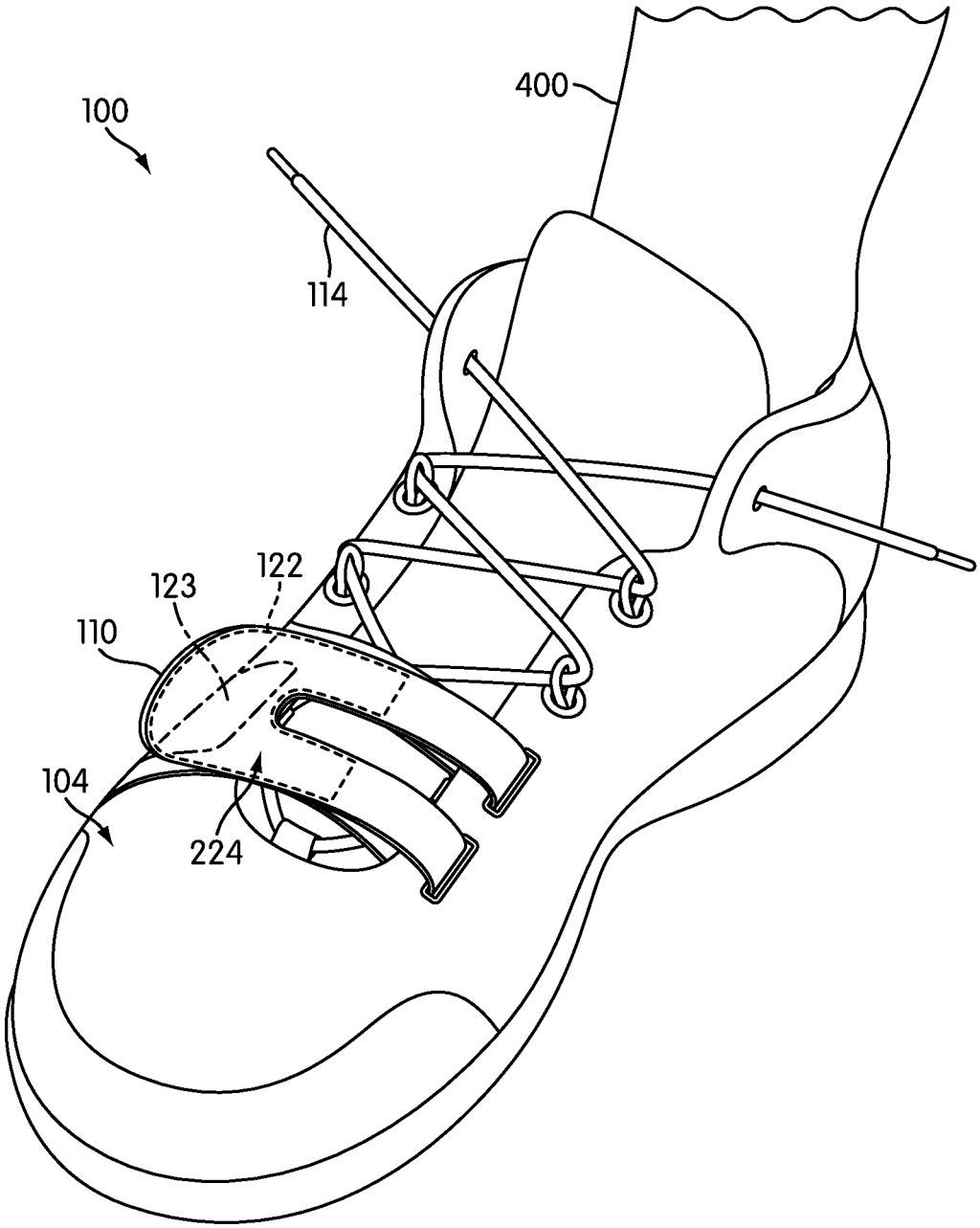
FIG. 6 is an isometric view of a preferred embodiment of an article of footwear with strap closed.

After lacing system 114 has been adjusted so that upper 104 is conformed to wearer's foot 400, strap 110 may be tightened to adjust the degree to which upper 104 is conformed to forefoot region of foot 400. Referring to FIG. 6, strap 110 has been tightened and secured in place. Adjusting strap is achieved by pulling second portion 224 of strap 110. As second portion 224 of strap 110 is pulled, first portion 220 of strap 110 tightens, constraining the movement of the forefoot of wearer's foot 400 within upper 104. The wearer may adjust strap 110 to suit any particular need. In some situations, a wearer may have large toe knuckles, and strap 110 may be only slightly tightened to allow for a comfortable fit. In other situations, the wearer may have a small forefoot region and may significantly tighten strap 110 in order to reduce the possibility of in-shoe motion of the forefoot.

Generally, a provision for securing strap 110 in place once the wearer has tightened is preferably included in article of footwear 100. Typically, a strap would be secured by fixing it at opposing ends of an upper. However, in some embodiments, a strap that is disposed within openings in upper may fix both ends of strap on the side of upper opposite openings. In a preferred embodiment, second portion 224 of strap 110 includes some attachment region for securing strap 110 to maintain the tension in strap 110. Likewise, a mating attachment region is preferably disposed on first side 142 of upper 104. Provision on second portion 224 and mating provision on first side 142 preferably provide a mechanism for securing strap in place once tightened. In a preferred embodiment, first attachment region 122 is disposed on second portion 224 of strap 110. Additionally, second attachment region 123 is preferably disposed on first side 142 of upper 104

Preferably, provision for securing tension applied by strap 110 is some closure mechanism. The closure mechanism may be a zipper, a button and button hole, a snap, a magnet, or some other closure mechanism. More preferably, closure mechanism is a hook and loop system. In a preferred embodiment, hook and loop closure system is a Velcro® closure system. Using hook and loop region 122 and mating hook and loop region 123, tension applied by strap 110 on a wearer's foot may be secured. By joining first attachment region 122 and second attachment region 123, strap 110 is releasably fastened to upper 104. This fastening keeps first strap 110 taught and upper 104 secured as desired on the wearer's foot.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

an upper including a throat region, a forefoot region, a heel region opposite the forefoot region, a first side, and a second side opposite the first side, the upper configured to be adjustably tightened around a wearer's foot;

a sole attached to the upper;

the upper including a lacing system and a strap system;

the strap system including a strap disposed in the forefoot region of the upper and having a first portion, a second portion, and an intermediate portion between the first portion and the second portion;

the lacing system including a set of lace eyelets disposed along the throat region;

wherein the first portion of the strap is fixed to the first side of the upper and wherein the strap extends across the article of footwear to the second side of the upper;

wherein the intermediate portion of the strap is disposed through the second side of the upper via a first slot and a second slot on the second side of upper;

wherein the set of lace eyelets includes at least one eyelet that is disposed between the heel region of the upper and both of the first slot and the second slot, the first slot and the second slot being aligned with the at least one lace eyelet of set of lace eyelets; and wherein the lacing system is associated with the strap system by a first lace eyelet that is separate from the set of lace eyelets and attached to an inner surface of the throat region of the upper between the first and second slots, the first lace eyelet being disposed near the forefoot region of the upper.

2. The article of footwear according to claim 1, wherein the lacing system includes a shoe lace disposed beneath the strap.

3. The article of footwear according to claim 1, wherein the intermediate portion of the strap includes a first strip and a second strip parallel to the first strip, the first strip and the second strip joining together and being unified at the second portion of the strap, and the second portion of the strap including a first closure mechanism configured to be secured to a second closure mechanism disposed upon the second side of the upper.

4. The article of footwear according to claim 3, wherein the lacing system further includes a second lace eyelet that is separate from the set of lace eyelets and disposed opposite the first lace eyelet along the throat region of the upper between the first strip and the second strip.

5. The article of footwear according to claim 1, wherein the first lace eyelet includes a first end attached to an inner surface of the upper and a second end attached to the inner surface of the upper.

6. The article of footwear according to claim 1, wherein the first slot and the second slot are aligned with a plurality of the eyelets of the set of lace eyelets.

7. The article of footwear according to claim 6, wherein the lacing system includes a second lace eyelet that is separate from the set of lace eyelets and disposed along the throat region of the upper in a position opposite the first lace eyelet, a third lace eyelet that is separate from the set of lace eyelets and disposed along the throat region of the upper in a position opposite the heel region of the upper, and a shoe lace disposed underneath the strap system and through the first lace eyelet, the second lace eyelet, the third lace eyelet, and the set of lace eyelets, and wherein the lacing system applies tension to the upper to reduce the size of a throat opening.

8. An article of footwear comprising:

an upper including a throat region, a forefoot region, a heel region opposite the forefoot region, a first side, and a second side opposite the first side, the upper being configured to be adjustably tightened around a wearer's foot;

a sole attached to the upper;

a lacing system including a set of lace eyelets disposed on an outer surface of the upper along the throat region of the upper;

a strap, including a first portion, a second portion, and an intermediate portion containing an elongated slot, the strap being disposed between the set of lace eyelets and the forefoot region;

the first portion of the strap being fixed to a first side of the upper and extendable across the article of footwear to a second side of the upper;

the intermediate portion of the strap being disposed through at least one opening in the second side of upper;

a first lace eyelet that is separate from the set of lace eyelets and disposed upon an inner surface of the upper and aligned with the elongated slot; and wherein the set of lace eyelets are disposed entirely between the strap and the heel region and the at least one opening is aligned with at least one eyelet of the set of lace eyelets.

9. The article of footwear according to claim 8, wherein the first lace eyelet includes a lace receiving portion disposed entirely within the upper and the set of lace eyelets each include a lace receiving portion disposed entirely on the outside of the upper.

10. The article of footwear according to claim 8, wherein all of the lace eyelets of the set of lace eyelets are aligned with the at least one opening.

11. The article of footwear according to claim 8, wherein the first eyelet is not aligned with the at least one opening or the set of lace eyelets.

12. The article of footwear according to claim 11, wherein the lacing system includes a second lace eyelet that is separate from the set of lace eyelets and disposed within the upper and aligned with the elongated slot and a third lace eyelet that is separate from the set of lace eyelets and disposed along the throat region of the upper in a position opposite a heel region of the upper.

13. The article of footwear according to claim 12, wherein the lacing system includes a shoe lace disposed through the first lace eyelet, the second lace eyelet, the third lace eyelet, and the set of lace eyelets, and wherein the shoe lace is disposed at least partially beneath the strap.

* * * * *